US007969047B2

(12) United States Patent
Hu

(10) Patent No.: US 7,969,047 B2
(45) Date of Patent: Jun. 28, 2011

(54) INTELLIGENT SWITCH SOCKET

(75) Inventor: Baineng Hu, Cixi (CN)

(73) Assignee: Ningbo Baihuang Electric Appliances Co. Ltd, Huximen Henghetown, Cixi (CN)

( * ) Notice: Subject to any disclaimer, the term of this patent is extended or adjusted under 35 U.S.C. 154(b) by 191 days.

(21) Appl. No.: 12/479,453

(22) Filed: Jun. 5, 2009

(65) Prior Publication Data

US 2010/0117457 A1 May 13, 2010

(30) Foreign Application Priority Data

Nov. 10, 2008 (CN) ..... 2008 10 122184

(51) Int. Cl.
*H01H 9/54* (2006.01)

(52) U.S. Cl. ..... 307/140

(58) Field of Classification Search ..... 307/140
See application file for complete search history.

(56) References Cited

U.S. PATENT DOCUMENTS

2005/0157451 A1* 7/2005 Kuo ..... 361/622
* cited by examiner

*Primary Examiner* — Robert L. DeBeradinis
(74) *Attorney, Agent, or Firm* — Quimet Law Offices; Jeffrey R. Ouimet

(57) ABSTRACT

An intelligent switching on/off socket includes a housing containing master jacks and slave jacks respectively containing master conducting strips and slave conducting strips, and a control circuit. The control circuit includes a current sampling circuit connected to the master conducting strips and a signal amplification circuit. The signal amplification circuit amplifies the sampled current and passes the signal to both a signal comparator, and to a reference signal acquisition circuit which in turn passes the reference signal to a memorizer. The signal comparator compares the reference current signals and current amplification signals, and is connected to a control output circuit. The control output circuit is connected to a relay which is connected to the slave conducting strip. The reference signal acquisition circuit provides a learning function such that multiple electrical devices with differing power needs can be switched on or off respectively depending on their individual power needs.

1 Claim, 1 Drawing Sheet

INTELLIGENT SWITCH SOCKET

BACKGROUND OF THE INVENTION (I) Technology Field

The invention relates to an intelligent switching on/off socket.

(II) Background Technology

The general structure of existing power supply sockets includes a housing, jacks arranged in the housing, conducting strips arranged in the jacks, and a parallel connection relationship between the sockets. When in use, the plugs of multiple electric devices are plugged into different jacks to form circuits with parallel connection to obtain power supply for the work. However, jacks in sockets are unrelated to one another, every electrical device being connected to the socket independently of each other, and equipment will not stop working when another device stops working. Therefore, energy waste will occur on some auxiliary equipment following the work of core equipment. (E.g., computers and printers: the work of printers depends on computers, and after computers stop working, work of printers is not necessary again. TV sets and sound boxes: the work of sound boxes depends on TV sets, and after TV sets stop working, the work of sound boxes is not necessary again). In order to avoid energy waste, the power supply of core equipment and auxiliary equipment can only be switched off one by one, and the operation is very troublesome. Therefore, some intelligent sockets with master and slave jacks have been invented with master conducting strips arranged in master jacks and slave conducting strips arranged in slave jacks. In use, the power plugs of core equipment are plugged into the master jacks and the power plugs of auxiliary equipment are plugged into slave jacks. Such a structure enables the auxiliary equipment to be switched off with switching off of core equipment and switched on with switching on of core equipment. The principle is that the difference in power magnitude of the master electric equipment when switching off and on is used to control switching off and switching on of power supply. The disadvantage of existing intelligent switching on/off sockets is: all modes have fixed signal acquisition. However, because the master electric equipment comes in a wide variety and the power difference of electric equipment is very large, great limitation exists in practical application.

BRIEF SUMMARY OF THE INVENTION

In order to overcome the disadvantage of great limitation in application of intelligent sockets, the invention provides an intelligent socket capable of learning.

The invention solves this technical problem by providing: an intelligent switching on/off socket which includes a housing, jacks arranged on said housing, said jacks include master jacks and slave jacks, master conducting strips arranged in the master jacks, and slave conducting strips arranged in the slave jacks;

The intelligent switch socket is characterized in that: a control circuit is also arranged in said housing to make the slave conducting strips connect or disconnect upon connecting or disconnecting of the master conducting strips. The control circuit includes: a current sampling circuit used for current sampling when switching on/off power of the master load; a signal amplification circuit used for amplifying sampling current signals; a reference signal acquisition circuit to determine the magnitude of a reference current according to current amplification signals; a memorizer to save the reference current signal acquired by the reference signal acquisition circuit; a signal comparator to compare the values of the reference current signals with the values of the current amplification signals; a control output circuit to send out control signals in accordance with the compared results from the signal comparator; and a relay to receive control of the control signal from the control output circuit;

The relay is connected with the slave conducting strips, the current sampling circuit is connected respectively with an input end of the signal amplification circuit and the master conducting strips, an output end of the signal amplification circuit is connected respectively with an input end of the reference signal acquisition circuit and an input end of the signal comparator, an output end of the reference signal acquisition circuit is connected with an input end of the memorizer, an output end of the memorizer is connected with an input end of the signal comparator, an output end of the signal comparator is connected with an input end of the control output circuit, and an output end of the control output circuit is connected with the relay.

In application, the invention is plugged into the commercial power supply, the power plug of the master load is plugged into the master jack of the invention and the power plug of the auxiliary load is plugged into the slave jack of the invention, whence the power switch of the master electric equipment may be switched on entering standby state. The sampling current is acquired via current sampling circuit upon switching on of the master load. The signals of the sampling current are amplified via the signal amplification circuit and sent into the signal comparator; the value of the reference current is determined by the reference signal acquisition circuit in accordance with the current amplification signal. The value of the reference current is memorized in the memorizer. The signal comparator compares the values of the reference current signals in the memorizer with the values of the current amplification signals. When the power supply of the master load is interrupted, a change in the magnitude of the current is caused due to the difference in power of power electric equipment when switching on/off. Both the value of the sampling current acquired by the current sampling circuit and the subsequent amplified value of the current amplification signals generate change. The detected change of current amplification signals are compared on the basis of a conference current in the signal comparator, and information is transferred to the control output circuit, and then disconnection of the relay is controlled by the control output circuit to make the slave conductive strip lose power.

Advantages include: the learning function of the invention can be realized via the reference signal acquisition circuit, i.e., different reference signals acquired through the reference signal acquisition circuit may be compared when using electric equipment with different power, therefore the invention may be applied to all kinds of electric equipment with little limitation.

DETAILED DESCRIPTION OF THE INVENTION

Figure 1:
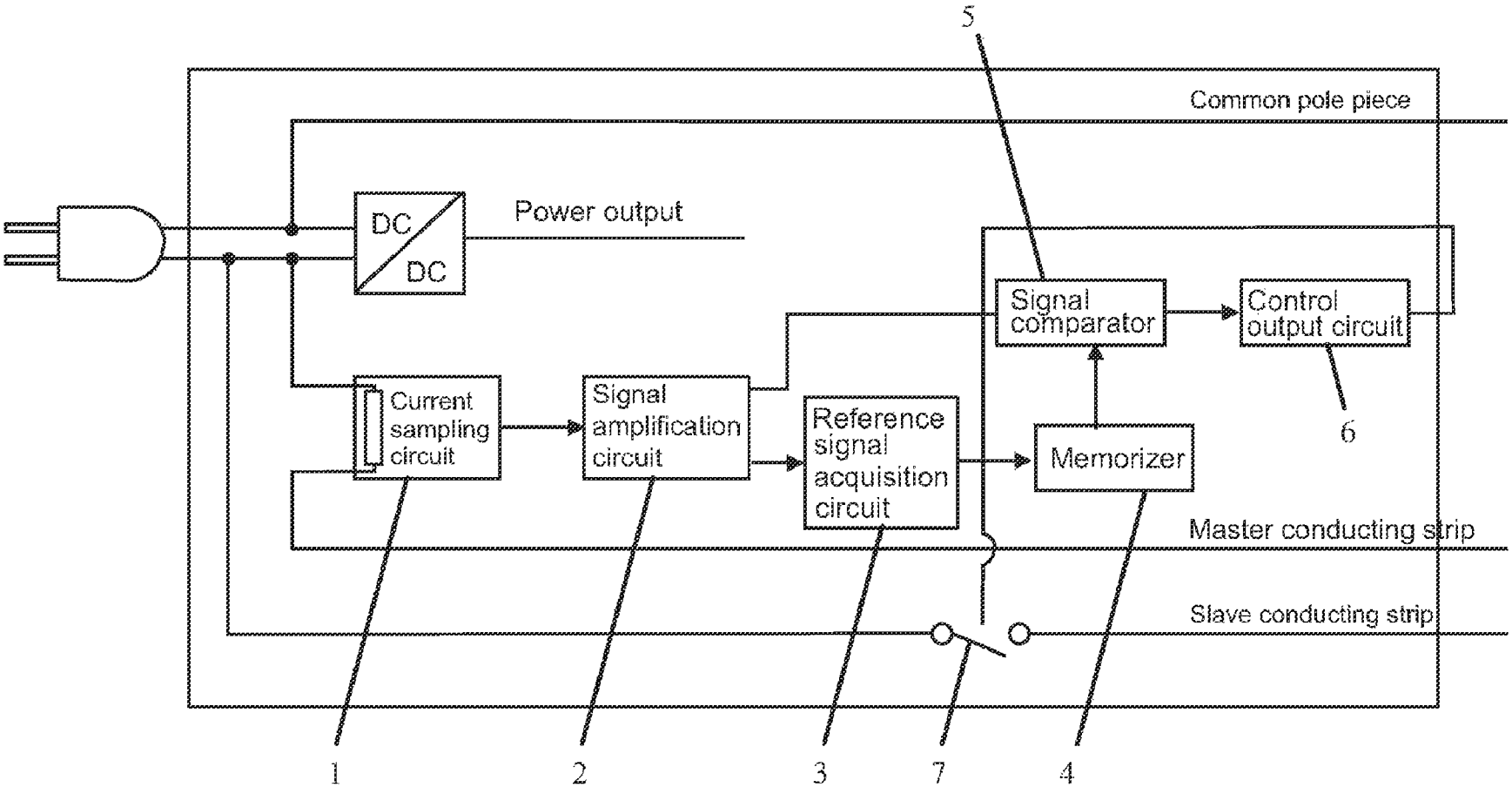
FIG. 1 presents the basic principles of the invention.

The invention will be explained in further detail with reference to the attached figure and specific modes of implementation as follows.

Referring to FIG. 1, an intelligent switching on/off socket, which includes a housing, jacks arranged in said housing, said jacks including master jacks and slave jacks, master conducting strips arranged in the master jacks and slave conducting strips arranged in the slave jacks.

A control circuit is also arranged in the housing to make slave conducting strips connect or disconnect upon connection or disconnection of the master conducting strips. The control circuit includes: a current sampling circuit 1 used for current sampling when switching on/off the power of the master load; a signal amplification circuit 2 used for amplifying sampling current signals; a reference signal acquisition circuit 3 to determine the magnitude of a reference current according to current amplification signals; a memorizer 4 to save the reference current signal acquired by the reference signal acquisition circuit 3; a signal comparator 5 to compare the values of the reference current signals in the memorizer 4 with the values of the current amplification signals; a control output circuit 6 to send out control signals in accordance with the results of the signal comparator 5 and a relay 7 to receive control of the control signal of the control output circuit 6.

The relay 7 is connected with the slave conducting strips, the current sampling circuit 1 is connected respectively with the input end of the signal amplification circuit 2 and the master conducting strips, the output end of the signal amplification circuit 2 is connected respectively with the input end of the reference signal acquisition circuit 3 and the input end of the signal comparator 5, the output end of the reference signal acquisition circuit 3 is connected with the input end of the memorizer 4, the output end of the memorizer 4 is connected with the input end of the signal comparator 5, the output end of the signal comparator 5 is connected with the input end of the control output circuit 6, and the output end of the control output circuit 6 is connected with the relay 7.

In application, invention is plugged into the commercial power supply, the power plug of the master load is plugged into the master jack of the invention and the power plug of the auxiliary load is plugged into the slave jack of the invention, whence the power switch of the master electric equipment may be switched on entering standby state. The Sampling current is acquired via the current sampling circuit 1 upon switching on of the master load. Signals of the sampling current are amplified via the signal amplification circuit 2 and sent into the signal comparator 5; the value of the reference current is determined by the reference signal acquisition circuit 3 in accordance with the current amplification signal. The value of the reference current is memorized in the memorizer 4. The signal comparator 5 compares the values of the reference current signals in the memorizer 4 with the values of the current amplification signals. When the power supply of the master load is interrupted, a change in the magnitude of the current is caused due to the difference in power of power electric equipment when switching on/off. Both value of the sampling current acquired by the current sampling circuit 1 and the subsequent amplified value of the current amplification signals generate change. The detected change of current amplification signals is compared on the basis of a conference current in the signal comparator 5, and the information is transferred to the control output circuit 6, and then disconnecting of the relay 7 is controlled by the control output circuit 6 to make the slave conductive strip lose power.

I claim:

1. An intelligent switching on/off socket, which includes a housing, jacks arranged in said housing, said jacks including master jacks and slave jacks, master conducting strips arranged in master jacks and slave conducting strips arranged in slave jacks, wherein a control circuit is further arranged in said housing to make the slave conducting strips connect or disconnect upon connection or disconnection of the master conducting strips, the control circuit including a current sampling circuit used for current sampling when switching on/off the power of the master conducting strip; a signal amplification circuit used for amplifying sampling current signals; a reference signal acquisition circuit to determine the magnitude of a reference current according to current amplification signals; a memorizer to save reference current signal acquired by the reference signal acquisition circuit, a signal comparator to compare values of reference current signals with values of current amplification signals; a control output circuit to send out control signals; and a relay to receive control of the control signal of the control output circuit; wherein said relay is connected with said slave conducting strips, said current sampling circuit is connected respectively with an input end of said signal amplification circuit and master conducting strips, an output end of said signal amplification circuit is connected respectively with an input end of said reference signal acquisition circuit and an input end of the signal comparator, an output end of said reference signal acquisition circuit is connected with an input end of said memorizer, an output end of said memorizer is connected with an input end of said signal comparator, an output end of said signal comparator is connected with an input end of said control output circuit, and an output end of the control output circuit is connected with said relay.

* * * * *